United States Patent [19]

Koump

[11] 4,312,638

[45] Jan. 26, 1982

[54] COAL GASIFICATION PROCESS

[75] Inventor: Valentin V. Koump, Greensburg, Pa.

[73] Assignee: Westinghouse Electric Corp., Pittsburgh, Pa.

[21] Appl. No.: 141,497

[22] Filed: Apr. 18, 1980

[51] Int. Cl.[3] ..... C10J 3/54

[52] U.S. Cl. ..... 48/197 R; 48/203; 48/206; 48/210

[58] Field of Search ..... 48/197 R, 202, 203, 48/206, DIG. 1, 210; 252/373

[56] References Cited

U.S. PATENT DOCUMENTS

| | | | |
|---|---|---|---|
| 2,577,632 | 12/1951 | Roetheli | 48/203 |
| 2,884,303 | 4/1959 | Metrailer | 48/206 |
| 3,847,563 | 11/1974 | Archer et al. | 48/206 |
| 3,927,996 | 12/1975 | Knudsen et al. | 48/202 |

*Primary Examiner*—Peter F. Kratz
*Attorney, Agent, or Firm*—R. D. Fuerle

[57] ABSTRACT

A process for gasifying coal and other carbonacaeous matter is disclosed which produces fuel gas containing low concentrations of polycyclic aromatic hydrocarbons. In this process the polycyclic aromatic hydrocarbons released by the coal during devolatilization and formed during pyrolysis of volatile matter are decomposed thermally in the presence of hydrogen, at a sufficiently high partial pressure (obtained by increasing the total pressure in the gasifier) to prevent polymerization of free radicals formed during pyrolysis. A relationship between the temperature, the gas residence time in the gasification reactor, the hydrogen partial pressure (i.e., total pressure in the gasifier), and the coal feed conditions are specified to achieve "clean" coal gasification.

3 Claims, 1 Drawing Figure

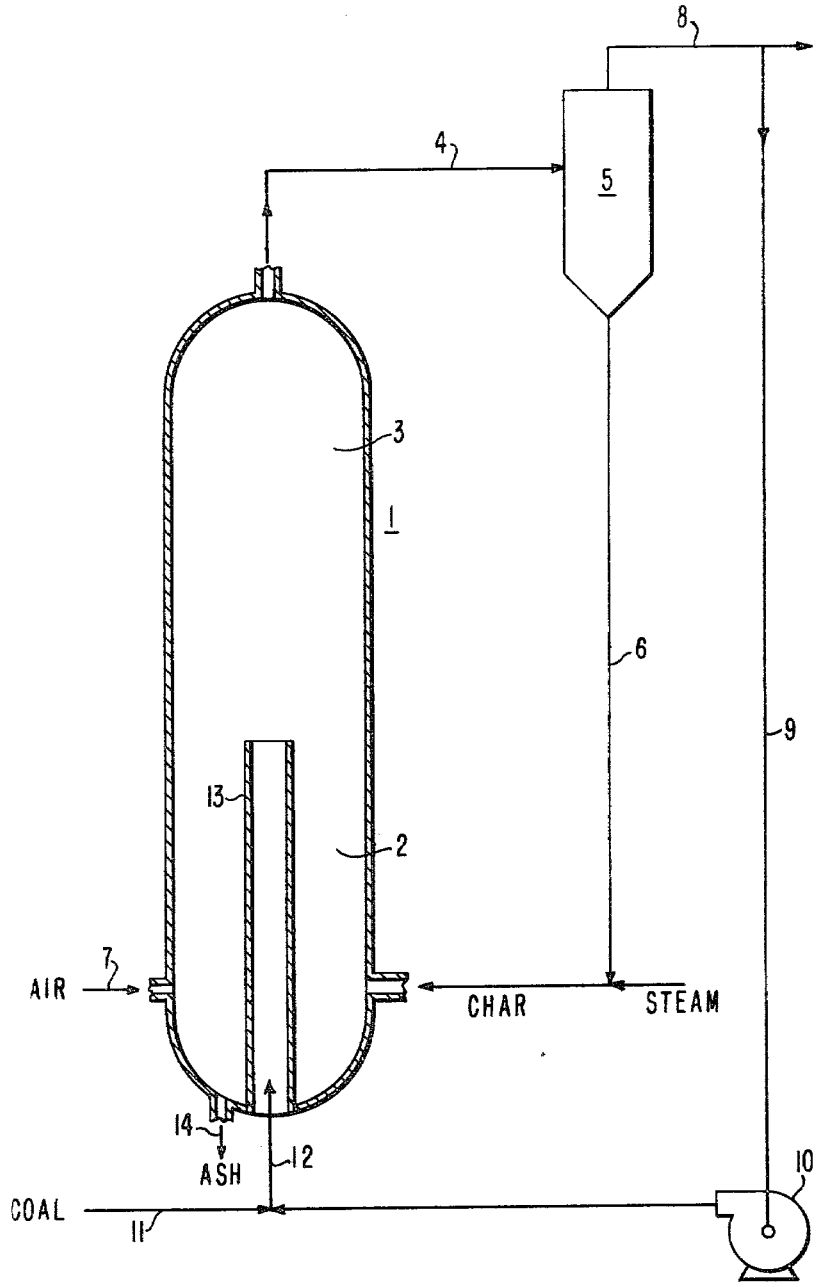
8
4
5
3
1
6
9
13
2
7
AIR
CHAR
STEAM
14
ASH
12
10
COAL
11

COAL GASIFICATION PROCESS

BACKGROUND OF THE INVENTION

Raw fuel gas produced by most commercial fuel gasifiers and gasifiers now under development contains various concentrations of coal tar, polycyclic aromatic hydrocarbons, and soot. These can cause serious operational problems in heat recovery and gas cleaning, but more importantly, they represent a serious environmental hazard. Many of the polycyclic aromatic compounds found in raw synthetic fuel gases are either direct or latent carcinogens.

The current approach to removing these compounds from the fuel gas involves adding gas cleaning systems to the coal gasifiers to remove the contaminants present in the fuel gas, including coal tar, polycyclic aromatic hydrocarbons, and soot. There are two types of gas cleaning systems currently in use or under consideration. In "cold gas cleaning," the raw fuel gas is cooled either by direct contact with water in a spray tower or in a scrubber, or by heat exchanger with the clean fuel gas in a high temperature heat exchanger. After cooling, the gas is cleaned to remove tar, polycyclic aromatic hydrocarbons, particulates, sulfur compounds, ammonia, and trace contaminants. In "hot gas cleaning," an attempt is made to remove particulate matter, sulfur compounds (e.g., $H_2S$, COS), and trace contaminants (e.g., $NH_3$, alkali metals, etc.), at high temperature (e.g. about 1600° F.).

In cold gas cleaning, coal tar and polycyclic aromatic hydrocarbons are condensed on particulate matter and enter waste water streams. If coal gasifiers employing "cold gas" cleaning systems are operated on a large scale, huge quantities of solid wastes and waste water, contaminated by polycyclic aromatic hydrocarbons will be generated. The safe disposal of these wastes constitutes an environmental problem of major proportion.

Because of their remarkable thermal stability, only a relatively small portion of the polycyclic aromatic hydrocarbons are decomposed in "hot" gas cleaning reactors. Under the conditions encountered in most coal gasification processes the free radicals formed during thermal decomposition of the polycyclic aromatic hydrocarbons repolymerize, forming higher molecular weight polycyclic aromatic hydrocarbons and soot.

These polycyclic aromatic compounds and soot will be burned together with the fuel gas in gas turbine combustors, power plant boilers, or industrial burners. Because polycyclic aromatic hydrocarbons resist complete combustion, some polycyclic aromatics, (though a smaller quantity than in systems using cold gas clean-up,) will be released into the atmosphere with the combustion products. These polycyclic aromatic hydrocarbons will condense on particulate matter in the air and will be breathed by people and animals. Eventually, these compounds will settle on the ground, water bodies, and plant life. Thus, neither of these two methods currently in use or under consideration represents a satisfactory long-term solution to the problem of polycyclic aromatic hydrocarbons in coal gasification.

The quantity of polycyclic aromatic hydrocarbons generated by coal gasifiers depends upon the temperature level at which the coal gasifiers are operating and decreases with increasing temperature. Although it is tempting to try to reduce the quantities of polycyclic aromatics released into the environment by operating coal gasifiers at high temperatures, this approach presents some new problems. High temperature gasifiers have substantially lower thermal ("cold gas") efficiencies than coal gasifiers operating at lower temperatures (because more carbon has to be burned to maintain the high temperature). Also, experience shows that coal ash and particulate matter from even the highest temperature gasifiers, contain significant amounts of polycyclic aromatic hydrocarbons.

To improve the efficiency of the use of coal resources and to reduce contamination of the environment, it is necessary to develop means to reduce the emissions of polycyclic aromatic hydrocarbons in coal gasifiers, irrespective of the temperature levels at which these gasifiers operate.

SUMMARY OF THE INVENTION

I have discovered that the concentration of polycyclic aromatic hydrocarbons in the raw fuel gas produced by coal gasifiers can be greatly reduced by maintaining a unique relationship between (1) the temperature at which coal gasifiers are operated, (2) the residence time of gas in coal gasification reactors, and (3) the partial pressure of hydrogen (i.e., the total pressure) in coal gasifiers, and by introducing the coal feed into the gasifiers under certain specific conditions.

Utilizing the principles of this invention I have invented the following two classes of clean coal gasifiers that can be operated in clean mode:

(1) Coal gasifiers of conventional mechanical design in which overall dimensions, location of the coal feed, temperature, total pressure and gasifier throughput meet certain unique relationships mentioned above. Generally, these gasifiers will be operated at a relatively high pressure.

(2) Coal gasifiers involving some novel mechanical features in which the conditions required to reduce the polycyclic aromatic hydrocarbons to a negligible level can be achieved at substantially lower pressure than in the first type of clean coal gasifiers.

PRIOR ART

Coal gasification is a relatively old art. Literally dozens of different coal gasifiers have been designed and operated, or are described in the literature.

In the past, the pressures at which coal gasifiers were operated (or were designed to operate) were determined primarily by the end use of the fuel gas. For example, coal gasifiers designed to supply fuel gas for gas turbines were operated at pressures ranging from 10 to 20 atmospheres—the pressure required by the gas turbines. Coal gasifiers that were designed to supply feed gas for synthesis of high BTU gas (methane, to be used as a substitute for natural gas), were operated at 1000–1500 psi., the natural gas pipeline pressures, etc.

The temperatures at which coal gasifiers were operated were fixed primarily by considerations involving thermal efficiency of coal gasification, the size of the coal gasification reactor for a given throughput and quantity of coal tar in the fuel gas.

In the past, the residence time of gas in coal gasification reactors was fixed primary by consideration of kinetics of coal gasification reactions and, in fluidized bed reactors, by mechanical support of the coal bed. Locations of the coal feed in various coal gasifiers were fixed by obvious technological considerations.

In the past no attempt was made to exploit the relationships involving temperature, pressure, residence time, and coal feed location in coal gasification reactors in order to achieve a specific purpose such as, for example, to reduce the concentration of polycyclic aromatic hydrocarbons in the fuel gas to negligible levels.

DESCRIPTION OF THE INVENTION

The accompanying drawing is a side view in section of a certain presently preferred embodiment of a gasifier according to this invention.

In the drawing, gasifier 1 consists of a vessel having an oxidizing zone 2 in its lower portion and a reducing zone 3 in its upper portion. The products which are produced in the gasifier leave the gasifier through conduit 4 where they pass to separator 5 which separates the solids from the gases. A cyclone, for example, can be used as a separator. The solids, primarily char, pass through conduit 6 into the gasifier. These char fines are burned to provide the heat for gasification. Air or oxygen is provided through passage 7 to support the combustion. The fuel gas product is taken off in line 8, but a portion of the fuel gas product is recycled through line 9 to pump 10 which increases its pressure before it is mixed with coal from line 11 and injected into the gasifier through line 12. The coal-fuel gas mixture enters the gasifier by passing through a heat conducting sleeve 13 which separates it from the oxidizing zone. Within the sleeve 13 fuel gas and coal mixture is heated, coal is devolatilized and a large fraction of polycyclic aromatic hydrocarbons is decomposed. The char is gasified both in the oxidizing zone 2 and in the reducing zone 3 above the sleeve. The ash is removed from the gasified through passage 14 in a conventional manner.

Coal gasifiers may be classified according to (a) the BTU content of the fuel gas, (b) the temperature at which gasifier operates, and (c) the type of coal gasification reactor used (i.e., fixed, fluidized, or entrained bed).

Low BTU coal gasifiers use coal, air, and steam and produce fuel gas containing 100–120 BTU per $ft^3$. This low BTU fuel gas contains carbon monoxide, carbon dioxide, hydrogen, water vapor, and nitrogen.

Medium BTU gasifiers use coal, oxygen and steam and produce fuel gas containing about 300 BTU per $ft^3$. This fuel gas contains carbon monoxide, carbon dioxide, hydrogen, and water vapor.

Low temperature gasifiers operate at 900° F. to about 1000° F. and produce great quantities of coal tar. Medium temperature gasifiers operate at about 1000° F. to about 1800° F. and produce only small quantities of coal tar, but significant quantities of coal tar residue which contains polycyclic aromatic hydrocarbons.

High temperature gasifiers operate at about 2500° F. to about 3000° F. and still produce enough polycyclic aromatic hydrocarbons to present a considerable environmental hazard.

In a fixed bed gasifier, hot gases are passed through a slowly moving bed of coal. In fluidized bed gasifiers small particles of char are fluidized by a stream of hot gas. Lower temperatures are generally used in fluidized bed gasifiers to prevent softening of coal ash particles. In entrained bed gasifiers fine coal particles are carried by a hot gas stream through the gasification reactor. Entrained bed gasifiers are generally operated at higher temperatures. In addition, coal may also be gasified in place, underground, by pumping air down one hole, igniting the coal and drawing the fuel gas up through a second hole 100 to 1000 ft. away.

The process of this invention can be used with any of these gasifiers, provided that all of the conditions of the invention are met.

Many carbonaceous materials can be gasified, such as anthracite, bituminous coal, lignite, waste paper, or agricultural wastes. Generally, during gasification, a portion of carbonaceous material is burned to provide the energy for endothermic gasification reactions. However, other heat sources such as nuclear energy, electrical energy, etc. can also be used to supply the energy for coal gasification.

In coal gasification, the polycyclic aromatic hydrocarbons originate from two sources. The first source is the coal itself as most coals contain various quantities of polycyclic aromatic groups in their polymeric structure. During the devolatilization and pyrolysis of coal, the polymeric structure of coal is destroyed and the polycyclic aromatic hydrocarbons are liberated. The second source of polycyclic aromatic hydrocarbons is the free radicals of various types which are formed during coal devolatilization and pyrolysis of volatile matter. The free radicals polymerize, forming polycyclic aromatic hydrocarbons and soot.

The purpose of this invention is to devise means to prevent the formation of polycyclic aromatic hydrocarbons during coal gasification by maintaining sufficiently high partial pressure of hydrogen, so that the free radicals, formed during pyrolysis of volatile matter, do not polymerize, but are hydrogenated to methane and other low molecular weight hydrocarbons.

It is also the object of this invention to decompose the polycyclic aromatic hydrocarbons liberated by the coal and formed during pyrolysis of carbonacous matter, by holding them at a high temperature for a sufficiently long time to effect thermal decomposition.

CONDITIONS FOR CLEAN COAL GASIFICATION

The rates of thermal decomposition of polycyclic aromatic hydrocarbons can be represented by the rate equation, $$(dc_i/d\theta) = -K_i C_i \quad (1)$$

The integrated form of equation (1) is, $$\frac{C_i}{C_i^o} = e^{-K_i\theta} \quad (2)$$

where, $C_i$ is concentration of a particular polycyclic aromatic hydrocarbon in gas phase, $C_i^o$ is initial concentration of polycyclic aromatic hydrocarbon in the gas phase, $K_i$ is first order rate constant for a particular polycyclic aromatic hydrocarbon, and $\theta$ is time (sec).

The rate constants for several polycyclic aromatic hydrocarbons, such as chrysene, anthracene, naphthalene, etc. are available over a range of temperatures of interest in coal gasification. These rate constants can be represented by an equation of the form, $$K_i = F_i(T) \quad (3)$$

By fixing fractional decomposition ($c_i/c_o$) of a particular polycyclic aromatic hydrocarbon and by combining equation (2) and equation (3) we obtain a relationship between the temperature (T) and the residence time ($\theta$) of gas in coal gasification reactor.

For example, if we select anthracene as the "critical" polycyclic aromatic compound and with to reduce its concentration 100,000,000 fold (i.e., $c_i/c_o=10^{-8}$), the residence times of gas in coal gasification reactor, required to achieve such a reduction in concentration, at various temperatures, are

| T (°F.) | $\theta$ (sec) | |
|---|---|---|
| 1000 | 60 | |
| 1700 | 33 | |
| 1800 | 18 | (4) |
| 1900 | 11 | |
| 2000 | 6.5 | |

For benzene, a more stable compound, for $c_i/c_o=10^{-8}$, the residence times of gas at various temperatures are,

| T (°F.) | $\theta$ (sec) | |
|---|---|---|
| 1000 | 400 | |
| 1700 | 150 | |
| 1800 | 60 | (5) |
| 1900 | 25 | |
| 2000 | 9 | |

In general it is convenient to use the most stable compounds (i.e., benzene or naphthalene) as the critical compound. When the concentration of the most stable compound is reduced by thermal decomposition to insignificant level, the concentrations of higher molecular weight (less stable) compounds will be reduced to truly negligible levels.

If we choose benzene as the critical compound, wish to achieve 100,000,000 fold reduction in its concentration, and decide to operate the coal gasifier at 1800° F., (for example), the residence time of the gas in coal gasification reactor should be at least 60 sec (Table 5, above).

In this example, the 100,000,000 fold reduction in the concentration of benzene will be achieved only if the partial pressure of hydrogen in the coal gasification reactor is high enough to prevent polymerization of free radicals formed during thermal decomposition.

In order to determine the minimum partial pressure of hydrogen required to prevent polymerization of free radicals, it is necessary to carry out a series of experiments in which samples of the carbonaceous matter are devolatilized under conditions (temperature and residence time) shown in Table (5), and partial pressures of hydrogen required to reduce the concentration of the critical compound by a factor of $10^{-8}$, are determined.

The measured values of partial pressures of hydrogen can be presented as a surface in T-$\theta$-$P_{H_2}$ coordinates. This surface will define the minimum partial pressures of hydrogen required, in a coal gasification reactor, to reduce the concentration of the critical polycyclic aromatic compound to the desired level (i.e., in the above example, a 100,000,000 fold reduction of concentration of benzene in the fuel gas).

Current indications are that for low BTU gasifiers, operating at 1800° F., the minimum partial pressure of hydrogen required to achieve "clean" coal gasification is 20 to 40 atm. Since the mole fraction of hydrogen in the low BTU gas is about 0.165, the total pressure required to achieve "clean" coal gasification is in the range of 1800 to 3600 psi.

Still another condition to be fulfilled to achieve clean coal gasification deals with the location where the coal is fed into the gasifier. Coal should be introduced into the gasifier at a point where the temperature and partial pressure of hydrogen are such that free radical formed during the devolatilization and pyrolysis of coal do not polymerize, but are hydrogenated, forming methane and other low molecular weight hydrocarbons. There are several ways to accomplish this.

For example, coal can be introduced in the middle portion of the gasifier where the partial pressure of hydrogen in the gas is relatively high (80–90% of hydrogen partial pressure in the top gas). Because of the relatively low temperature in the middle portion of the gasification reactor, a large residence time (hence large reactor volume) will be required to decompose the polycyclic aromatic hydrocarbons.

The second approach is shown in FIG. 1. In this case, coal is introduced in the lower part of the gasifier (where temperature is high) with recycled fuel gas, as a carrying medium through a heat conducting sleeve 13. The devolatization and pyrolysis of coal and thermal decomposition of polycyclic aromatic hydrocarbons, in this case, occur at a high temperature and under a high partial pressure of hydrogen. At high temperature, polycyclic aromatic hydrocarbons will be decomposed in a relatively short time, and therefore a short residence time of gas in coal gasification reactor (and smaller reactor volume) will be required. Furthermore, since a lower partial pressure of hydrogen is required at high temperatures to hydrogenate polycyclic aromatic hydrocarbons, it would be possible to operate the gasifier at lower total pressure.

I claim:

1. In a gasifier having an oxidizing atmosphere in its lower portion and a lower temperature reducing atmosphere in its upper portion, a process for gasifying carbonaceous matter to produce fuel gas containing negligible concentrations of undesirable polycyclic aromatic compounds comprising:

(1) selecting the fractional decomposition ratio R of the most stable polycyclic compound in the gas in said gasifier;

(2) selecting a temperature T for operating said gasifier and determining the rate constant K for the decomposition of said most stable polycyclic component at said temperature T;

(3) solving the equation $R=e^{-K\theta}$ for $\theta$ where $\theta$ is the residence time in seconds of said compound at temperature T;

(4) determining the minimum partial pressure of hydrogen necessary to reduce the concentration of said most stable polycyclic compound at temperature T and residence time $\theta$ by the ratio R;

(5) admitting said carbonaceous matter into the said gasifier at a point where the partial pressure of hydrogen exceeds said minimum partial pressure of hydrogen;

(6) gasifying said carbonaceous matter under the values of said temperature, residence time, and partial pressure of hydrogen to produce fuel gas containing low concentration of polycyclic aromatic compounds.

2. A process according to claim 1 wherein said carbonaceous matter is mixed with a portion of said fuel gas and said mixture enters the bottom of said gasifier inside a sleeve, which separates it from said oxidizing atmosphere and which conducts heat from said gasifier to the inside of said sleeve.

3. A process according to claim 1 or 2 wherein said carbonaceous matter is coal.

* * * * *